US010448755B1

(12) United States Patent
McDowell et al.

(10) Patent No.: US 10,448,755 B1
(45) Date of Patent: Oct. 22, 2019

(54) INLINE DISPLAY FOCAL

(71) Applicant: Target Brands, Inc., Minneapolis, MN (US)

(72) Inventors: Daniel K. McDowell, Minneapolis, MN (US); Andrew J. Liesveld, Omaha, NE (US)

(73) Assignee: Target Brands, Inc., Minneapolis, MN (US)

( * ) Notice: Subject to any disclaimer, the term of this patent is extended or adjusted under 35 U.S.C. 154(b) by 10 days.

(21) Appl. No.: 16/029,953

(22) Filed: Jul. 9, 2018

(51) Int. Cl.
*A47B 96/00* (2006.01)
*A47F 5/00* (2006.01)
*A47B 97/00* (2006.01)

(52) U.S. Cl.
CPC ..... *A47F 5/0018* (2013.01); *A47B 96/00* (2013.01); *A47B 97/00* (2013.01); *A47F 5/00* (2013.01)

(58) Field of Classification Search
CPC ..... A47F 5/00; A47F 5/0018; A47B 96/00; A47B 97/00
USPC ..... 211/87.01, 189, 90.01, 90.02, 118, 190, 211/191, 192, 193, 182, 183
See application file for complete search history.

(56) References Cited

U.S. PATENT DOCUMENTS 2,514,049 A * 7/1950 Graham ..... G09F 13/00 362/151
2,580,334 A * 12/1951 Vanderveld ..... A47B 47/00 211/135
2,681,262 A * 6/1954 Vincent ..... A47B 81/007 211/60.1
2,965,242 A * 12/1960 Grotke ..... A47B 47/021 211/190
2,965,243 A * 12/1960 Mapson ..... A47B 47/021 211/183
2,971,805 A * 2/1961 Weiss ..... A47F 5/103 108/185
2,991,889 A * 7/1961 Levy ..... A47B 91/00 211/190
3,015,400 A * 1/1962 Foster ..... A47F 5/103 211/183
3,182,812 A * 5/1965 Fenwick ..... A47B 57/42 211/187
3,263,821 A * 8/1966 Klene ..... A47F 5/103 108/108
3,322,288 A * 5/1967 Mayer ..... A47F 5/01 211/193

(Continued)

*Primary Examiner* — Jonathan Liu
*Assistant Examiner* — Devin K Barnett
(74) *Attorney, Agent, or Firm* — Leanne Taveggia Farrell; Westman, Champling & Koehler, P.A.

(57) ABSTRACT

A display fixture includes a gondola display unit having a plurality of adjacent gondola sections. Each gondola section has a base deck, a back wall supported by a pair of uprights and a toe kick located on a front of the base deck. An inline display focal is coupled to the gondola display unit to highlight one of the plurality of adjacent gondola sections and includes an upper frame, an outrigger and a kick plate assembly. A portion of the upper frame extends forward from the base deck and the toe kick of the gondola section. The outrigger is positioned forward of the base deck and the toe kick of the gondola section and includes at least two vertical members that depend downwardly from the upper frame to couple to the kick plate assembly that is attached to a front of the toe kick of the gondola section.

19 Claims, 10 Drawing Sheets

(56) References Cited

U.S. PATENT DOCUMENTS 3,335,874 A * 8/1967 Levy ..... A47F 7/144 108/108
3,419,933 A * 1/1969 Gossen ..... A47B 95/04 16/94 R
3,556,023 A * 1/1971 Marschak ..... A47B 57/045 108/1
3,556,308 A * 1/1971 McAleenan ..... A47F 5/08 211/134
3,587,867 A * 6/1971 Fenwick ..... A47F 5/103 211/183
3,601,256 A * 8/1971 Bowers ..... A47F 5/08 108/108
3,602,159 A * 8/1971 Marschak ..... A47F 5/103 108/187
3,669,036 A * 6/1972 Marschak ..... A47F 5/103 108/157.13
3,698,567 A * 10/1972 Fenwick ..... A47F 5/103 211/183
3,971,477 A * 7/1976 Bruderly ..... A47F 5/103 211/189
4,046,083 A * 9/1977 Murdoch ..... A47F 5/103 108/107
4,055,253 A * 10/1977 Oztekin ..... A47F 5/103 108/108
4,063,518 A * 12/1977 Bustos ..... A47F 5/101 108/137
4,108,085 A * 8/1978 Shepherd ..... A47F 5/103 108/108
4,148,535 A * 4/1979 Fenwick ..... A47B 47/04 16/95 R
4,159,814 A * 7/1979 Fibus ..... A47B 57/42 108/108
4,171,052 A * 10/1979 Winn ..... A47F 5/10 211/162
4,519,511 A * 5/1985 Mendenhall ..... A47B 57/30 108/107
4,541,675 A * 9/1985 Everett ..... A47F 5/00 211/175
4,611,866 A * 9/1986 Everett ..... A47F 5/00 211/175
4,646,656 A * 3/1987 Marschak ..... A47F 5/103 108/108
4,716,841 A * 1/1988 Suttles ..... A47F 5/103 108/108
4,744,475 A * 5/1988 St. Pierre ..... A47F 5/103 211/134
4,756,430 A * 7/1988 Spamer ..... A47F 7/16 108/108
4,762,235 A * 8/1988 Howard ..... A47B 57/46 108/109
4,785,946 A * 11/1988 Sorensen ..... A47F 5/0846 211/187
4,887,783 A * 12/1989 Franklin ..... A47F 5/0815 248/220.41
4,928,832 A * 5/1990 Overmann ..... A47B 47/022 108/108
4,982,852 A * 1/1991 Johansen ..... A47F 5/0093 211/162
5,014,862 A * 5/1991 Bustos ..... A47F 5/103 211/189
5,022,541 A * 6/1991 White ..... A47F 5/103 108/108
5,415,301 A * 5/1995 Bruton ..... A47B 96/1416 211/183
5,462,178 A * 10/1995 Wallach ..... A47F 5/02 211/163
5,477,971 A * 12/1995 Howard ..... A47F 5/101 108/108
5,524,977 A * 6/1996 Orawski ..... A47F 3/005 312/114
5,566,844 A * 10/1996 Bernardin ..... A47F 5/0846 211/162
5,607,070 A * 3/1997 Hellyer ..... A47F 5/108 211/189
5,611,442 A 3/1997 Howard
5,657,884 A * 8/1997 Zilincar, III ..... A47F 5/0043 211/103
5,660,286 A * 8/1997 Shea ..... A47F 5/08 211/189
5,660,287 A * 8/1997 Tryon ..... A47B 87/007 211/186
5,722,623 A * 3/1998 Gibson ..... A47F 5/0068 248/201
5,803,273 A * 9/1998 Menaged ..... A47F 5/0807 211/105.1
5,897,181 A * 4/1999 Avendano ..... F25D 23/062 29/525.11
6,024,230 A 2/2000 Menaged et al.
6,427,855 B2 * 8/2002 LaBruna, Jr. ..... A47F 5/103 211/187
6,467,635 B1 * 10/2002 McComb ..... A47F 7/30 211/175
6,533,134 B1 * 3/2003 Menaged ..... A47F 5/0807 211/119.003
6,659,295 B1 * 12/2003 De Land ..... A47B 96/04 211/184
7,048,131 B2 5/2006 Gay et al.
7,255,236 B1 * 8/2007 Sauder ..... A47B 96/022 211/135
7,886,919 B2 2/2011 Battaglia, Jr. et al.
8,028,846 B2 * 10/2011 Peota ..... A47B 91/00 108/108
8,231,016 B2 * 7/2012 Berdahl ..... A47F 3/12 211/119.003
8,607,997 B2 * 12/2013 Bergdoll ..... A47F 5/103 211/187
8,646,627 B2 * 2/2014 Bass ..... A47F 5/0093 211/162
8,776,414 B2 * 7/2014 Clark ..... G09F 15/00 108/107
8,782,936 B2 * 7/2014 Logan ..... G09F 7/10 40/606.01
8,959,813 B2 * 2/2015 Denby ..... A47F 5/10 211/175
9,217,273 B2 * 12/2015 Floersch ..... E06B 5/006
9,339,125 B1 * 5/2016 Floersch ..... E05B 73/0005
9,538,859 B1 * 1/2017 Johnson ..... A47F 5/0043
9,541,245 B2 * 1/2017 Floersch ..... A47F 3/001
9,700,155 B1 * 7/2017 Theisen ..... A47F 3/145
9,782,018 B2 * 10/2017 Hester-Redmond ..... A47F 5/08
9,795,229 B2 * 10/2017 Johnson ..... A47F 5/0056
9,978,295 B1 * 5/2018 Denby ..... G09F 15/0056
D830,745 S * 10/2018 Pedersen ..... D6/675
D833,184 S * 11/2018 Zobel ..... D6/675.4
10,117,527 B2 * 11/2018 Johnson ..... B65B 63/04
D835,437 S * 12/2018 Stukenberg ..... D6/675
D843,756 S * 3/2019 Johnson ..... D6/675
D848,771 S * 5/2019 McDowell ..... D6/675.2
2004/0009035 A1 * 1/2004 Hightower ..... A47B 95/002 403/403
2004/0020886 A1 * 2/2004 Scully ..... A47F 5/13 211/183
2005/0082954 A1 * 4/2005 Dunbar ..... A47B 77/04 312/228
2006/0016774 A1 * 1/2006 Bustos ..... A47B 45/00 211/186
2006/0213850 A1 * 9/2006 VanCalbergh ..... A47F 3/004 211/94.01
2006/0278589 A1 * 12/2006 Peponis ..... G09F 5/04 211/10
2007/0236111 A1 * 10/2007 Gray ..... A47B 96/02 312/138.1
2007/0267375 A1 * 11/2007 Battaglia ..... A47B 47/03 211/189
2008/0149576 A1 * 6/2008 Onachilla ..... A47F 1/12 211/85.5
2008/0251479 A1 * 10/2008 Arradondo ..... A47F 5/103 211/85.3

(56) References Cited

U.S. PATENT DOCUMENTS

2009/0184610 A1* 7/2009 Haws, Jr. ..... A47F 3/004 312/140.2
2009/0294392 A1* 12/2009 Stafford ..... A47F 5/0025 211/153
2010/0079042 A1* 4/2010 Eilers ..... A47B 47/0008 312/107
2011/0101836 A1* 5/2011 Gamble ..... A47B 95/002 312/293.3
2011/0115351 A1* 5/2011 McManic ..... A47B 45/00 312/270.1
2011/0168651 A1* 7/2011 Stenftenagel ..... A47B 57/404 211/42
2011/0309046 A1* 12/2011 Lee ..... A47B 47/03 211/182
2012/0042549 A1* 2/2012 Schattinger ..... G09F 13/18 40/541
2012/0280607 A1* 11/2012 Doberstein ..... F25D 23/00 312/401
2012/0285917 A1* 11/2012 O'Quinn ..... A47F 5/103 211/182
2013/0026321 A1* 1/2013 Richardson ..... A47B 95/002 248/235
2013/0175907 A1* 7/2013 Deneweth ..... A47B 77/06 312/111
2013/0193098 A1* 8/2013 Fanourgiakis ..... A47B 45/00 211/134
2014/0001131 A1* 1/2014 Johnson ..... A47F 5/0025 211/59.2
2014/0027397 A1* 1/2014 Knoll ..... A47F 5/16 211/183
2014/0032447 A1* 1/2014 Fisher ..... A47F 7/0021 705/500
2014/0252291 A1* 9/2014 Koering ..... E01D 19/103 256/64
2014/0353269 A1* 12/2014 Trinh ..... A47F 5/10 211/183
2016/0061429 A1* 3/2016 Waalkes ..... F21V 23/001 362/217.15

* cited by examiner

INLINE DISPLAY FOCAL

BACKGROUND

A retail store uses gondola display units to organize and present products or merchandise to customers for purchase. For example, the gondola display unit may include display shelves that both support the products for display while simultaneously indicating product price.

Often, retailers desire to highlight certain products that are being displayed for sale. For example, a retailer may want to bring certain products to the attention of the customer because the products have certain characteristics not possessed by similarly displayed products, such as branding, products that are on sale, new product offerings or products that have associated promotional incentives.

The discussion above is merely provided for general background information and is not intended to be used as an aid in determining the scope of the claimed subject matter.

SUMMARY

A display fixture includes a gondola display unit having a plurality of adjacent gondola sections. Each gondola section has a base deck, a back wall supported by a pair of uprights and a toe kick located on a front of the base deck. The display fixture further includes an inline display focal coupled to the gondola display unit to highlight one of the plurality of adjacent gondola sections and has an upper frame, an outrigger and a kick plate assembly. A portion of the upper frame extends forward from the base deck and the toe kick of the gondola section. The outrigger is positioned forward of the base deck and the toe kick of the gondola section and includes at least two vertical members that depend downwardly from the upper frame to couple to the kick plate assembly that is attached to a front of the toe kick of the gondola section.

A display fixture includes a gondola display unit having a plurality of adjacent gondola sections. Each gondola section has a base deck, a back wall supported by a pair of uprights and a toe kick located on a front of the base deck. The display fixture further includes a highlighter coupled to the gondola display unit to highlight one of the plurality of adjacent gondola sections and includes an upper frame, an outrigger and a kick plate assembly. The upper frame is coupled to the uprights of the highlighted gondola section and extends forward from the base decks and the toe kicks of the plurality of gondola sections. The outrigger is positioned forward of the base decks and the toe kicks of the plurality of gondola sections and includes at least two vertical members that depend downwardly from the upper frame to couple to the kick plate assembly that is attached to a front of the toe kick of the highlighted gondola section.

A method of drawing customer attention to merchandise located on one of a plurality of adjacent gondola sections in a retail store by focusing on a highlighted gondola section includes cantilevering an upper frame from a pair of uprights on the highlighted gondola section. The upper frame extends forward from the base decks and the toe kicks of the plurality of adjacent gondola sections. An outrigger includes two vertical members that depend downwardly from the upper frame and is located forward of the base decks and the toe kicks of the plurality of adjacent gondola sections. A kick plate assembly is attached to the toe kick of the highlighted gondola section so that the kick plate assembly is located forward of the base decks and the toe kicks of the plurality of adjacent gondola sections and is also attached to the two vertical members of the outrigger.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

A gondola display unit is a freestanding display fixture used in retail stores to display merchandise. Generally, a gondola section is positioned adjacent to a plurality of other gondola sections to form the gondola display unit. Embodiments described herein are directed to an inline display focal or highlighter that highlights merchandise located on one or more display shelves of a gondola display unit to draw customer attention. In particular, the inline display focal highlights a gondola section that is located between other gondola sections of the gondola display unit.

Figure 1:
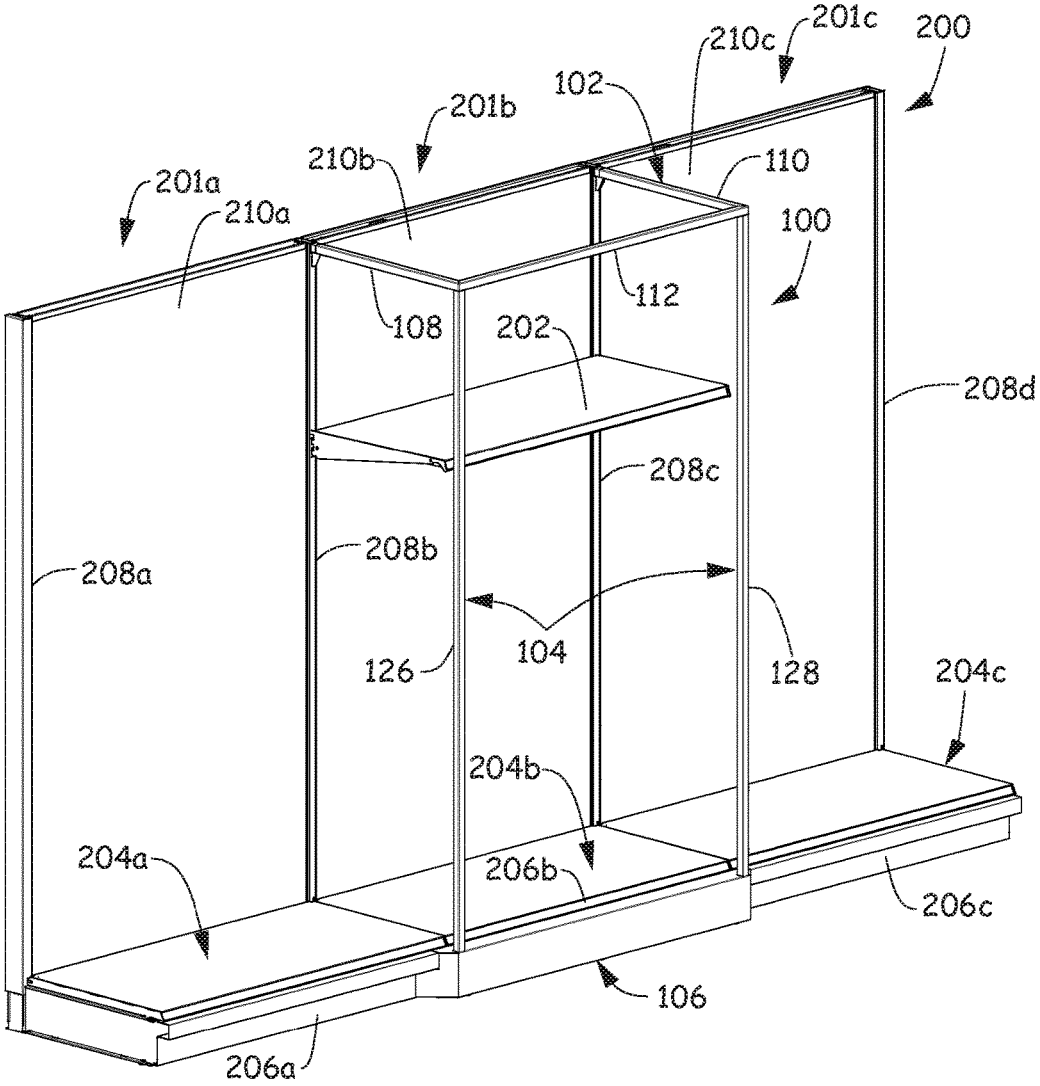
FIG. 1 is an assembled perspective view of an inline display focal that highlights products being displayed by a gondola display unit having a display shelf according to an embodiment.
Figure 2:
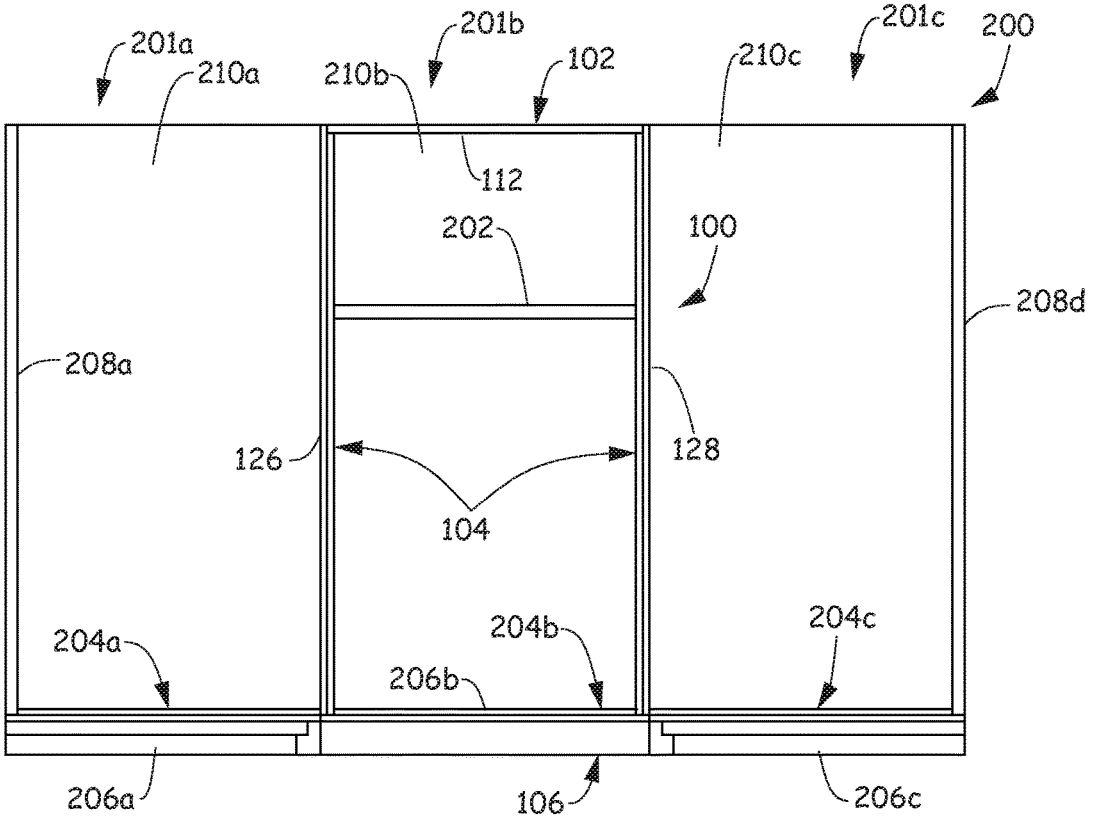
FIG. 2 is a front view of FIG. 1.
Figure 3:
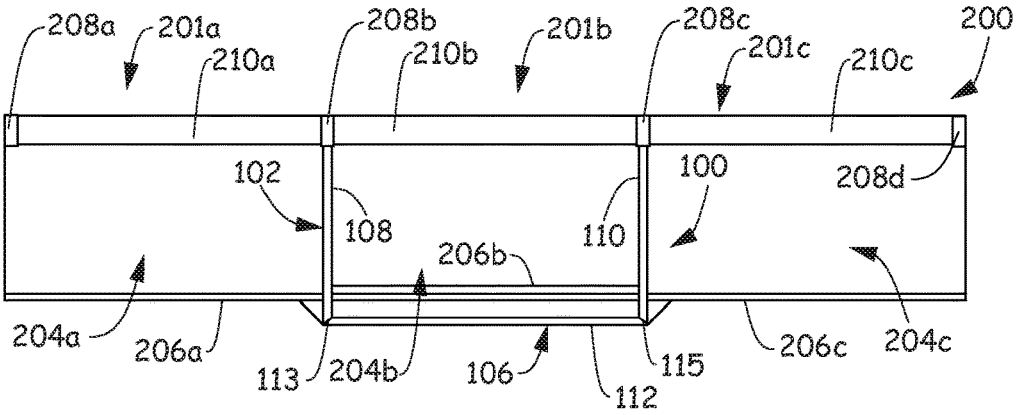
FIG. 3 is a top view of FIG. 1.
Figure 4:
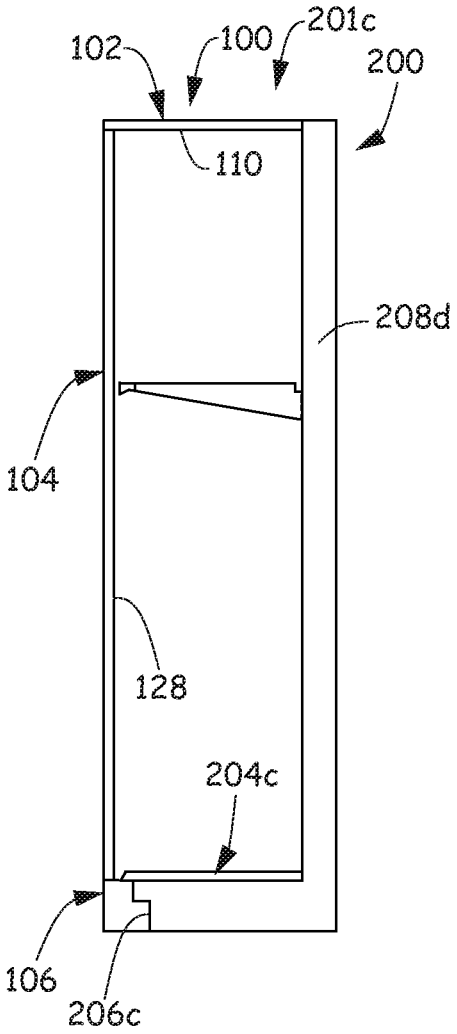
FIG. 4 is a right side view of FIG. 1, the left side view being a mirror image.

FIG. 1 is an assembled perspective view of an inline display focal 100 that highlights products being displayed by a gondola display unit 200 according to an embodiment. FIG. 2 is a front view, FIG. 3 is a top view and FIG. 4 is a right side view of FIG. 1. Gondola display unit 200 includes a plurality of adjacent gondola sections 201*a*, 201*b* and 201*c*. Each gondola section includes a corresponding base deck 204*a*, 204*b* and 204*c*, a toe kick 206*a*, 206*b* and 206*c* located on the front of each base deck 204*a*, 204*b* and 204*c*, a pair of uprights (selected from 208*a*, 208*b*, 208*c* and 208*d*) and a back wall 210*a*, 210*b* and 210*c*. As illustrated, gondola sections 201*a* and 201*b* share upright 208*b* and gondola sections 201*b* and 201*c* share upright 208*c*. In other words, each gondola section 201*a*, 201*b* and 201*c* shares an upright with an adjacent gondola section.

Gondola display unit 200 also includes at least one display shelf that is mounted to a pair of uprights. In particular, each gondola section may include one or more display shelves. In FIGS. 1-4, display shelf 202 is part of gondola section 201*b* that is to be highlighted by an inline display focal or highlighter and includes brackets that are mounted to the pair of uprights 208*b* and 208*c* of gondola display unit 200.

Figure 5:
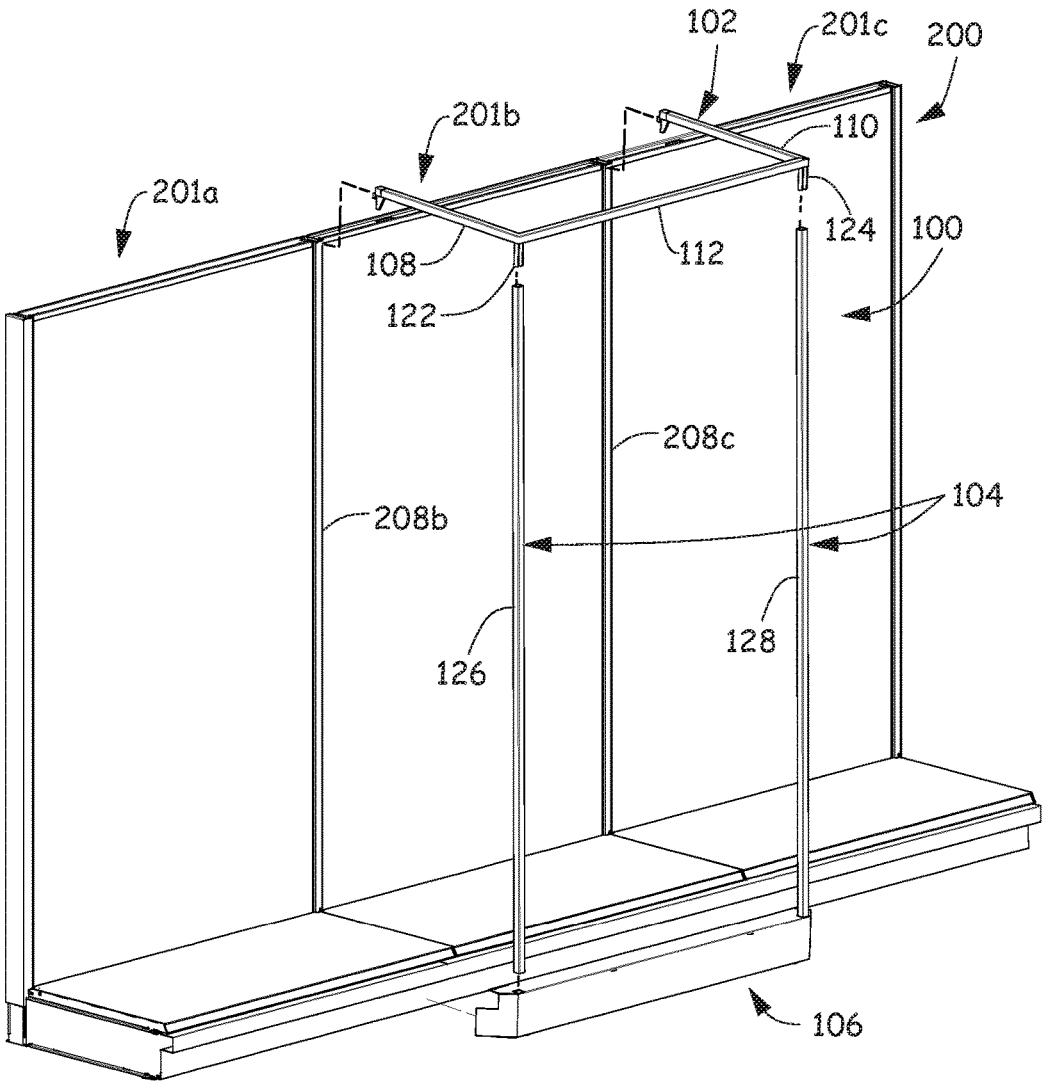
FIG. 5 is an exploded perspective view of the inline display focal of FIG. 1 with the display shelf removed.
Figure 6:
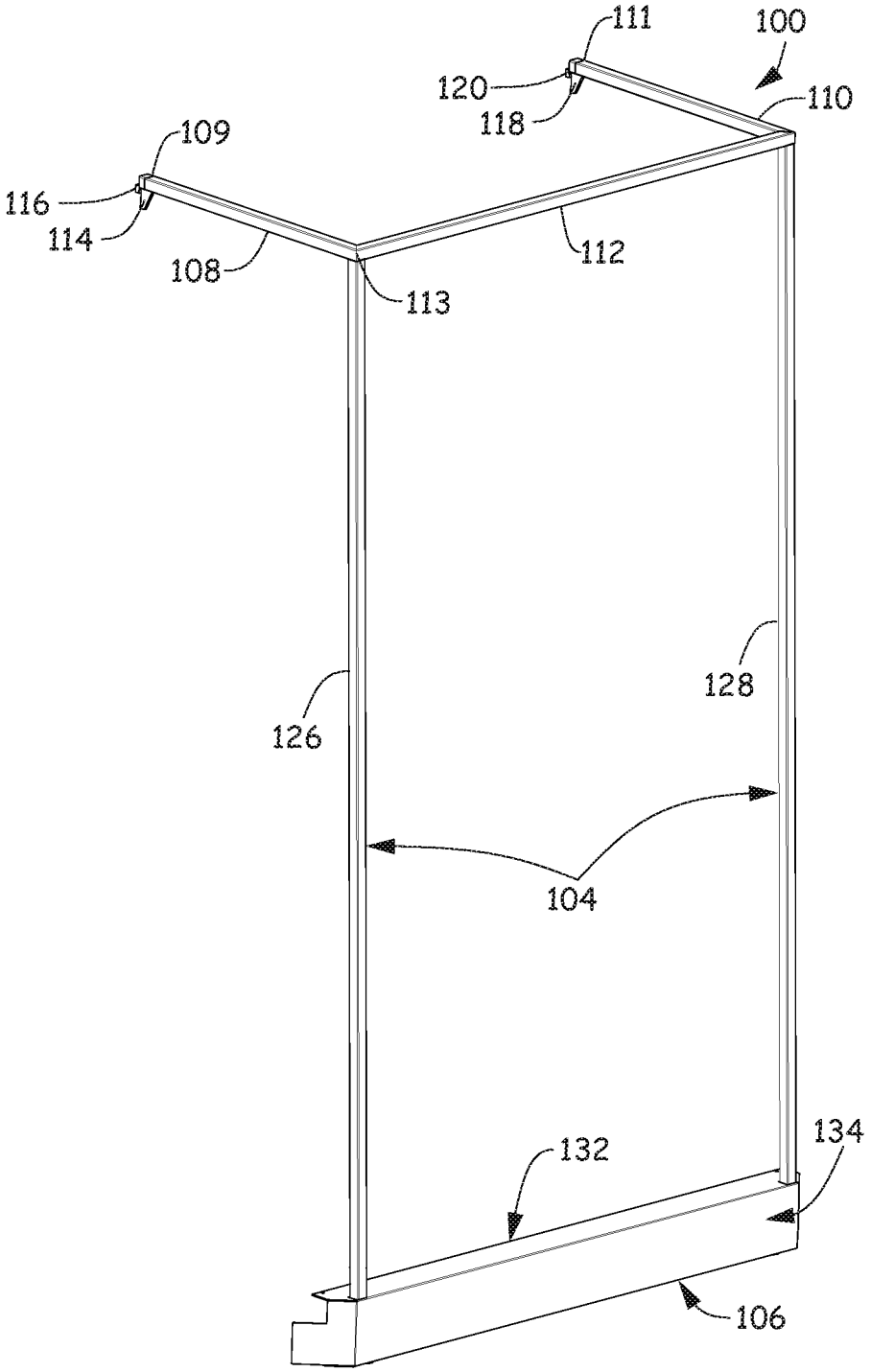
FIG. 6 is a perspective view of the inline display focal of FIG. 1 with the gondola display unit and display shelf removed.
Figure 7:
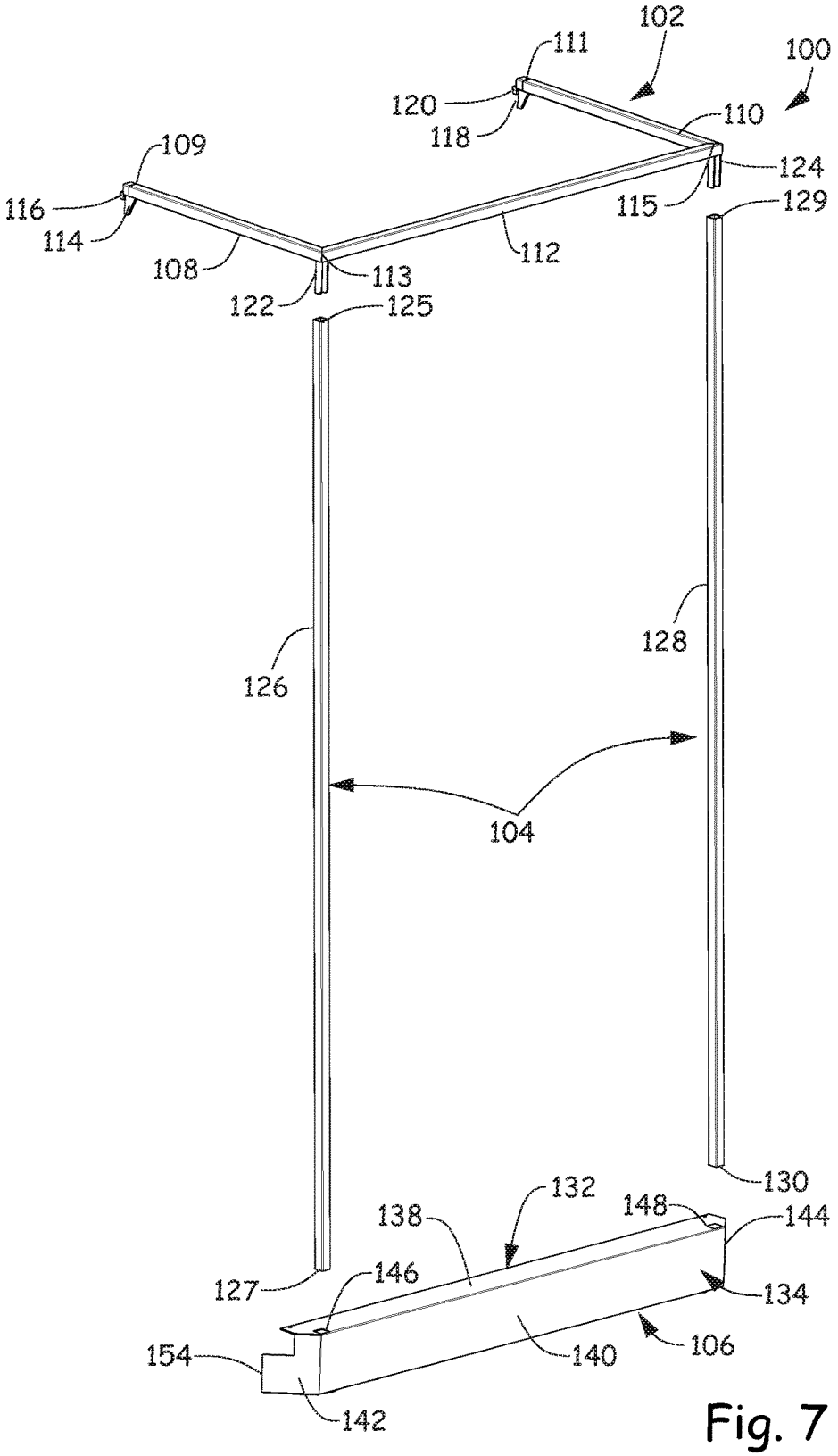
FIG. 7 is an exploded perspective view of the inline display focal illustrated in FIG. 6.

Coupled to gondola display unit 200 is an inline display focal or highlighter 100 for highlighting one of the plurality of adjacent gondola sections 201*a*, 201*b* and 201*c*. FIG. 5 is an exploded perspective view of inline display focal or highlighter 100 exploded from gondola display unit 200 with display shelf 202 removed. FIG. 6 is a perspective view of assembled inline display focal or highlighter 100 with gondola display unit 200 and display shelf 202 removed. FIG. 7 is an exploded perspective view of inline display focal or highlighter 100. As illustrated in FIGS. 1-5, inline display focal or highlighter 100 is configured to highlight gondola section 201*b* and includes an upper frame 102, an outrigger 104 and a kick plate assembly 106.

Figure 8:
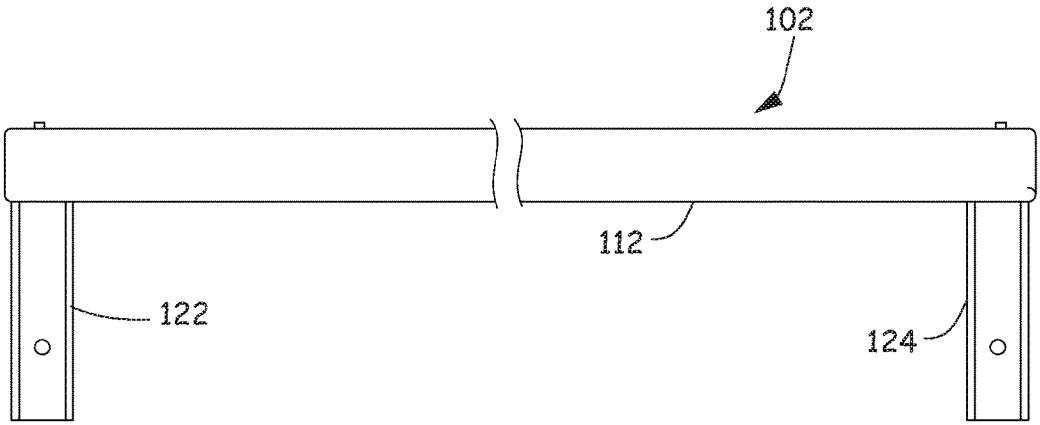
FIG. 8 is a front view of portions of the upper frame of the inline display focal illustrated in FIG. 7.
Figure 9:
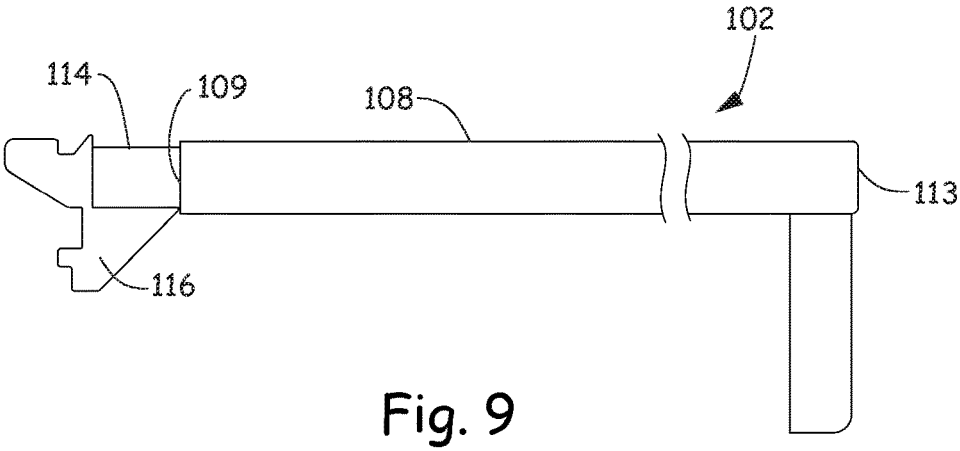
FIG. 9 is a left side view of FIG. 8.
Figure 10:
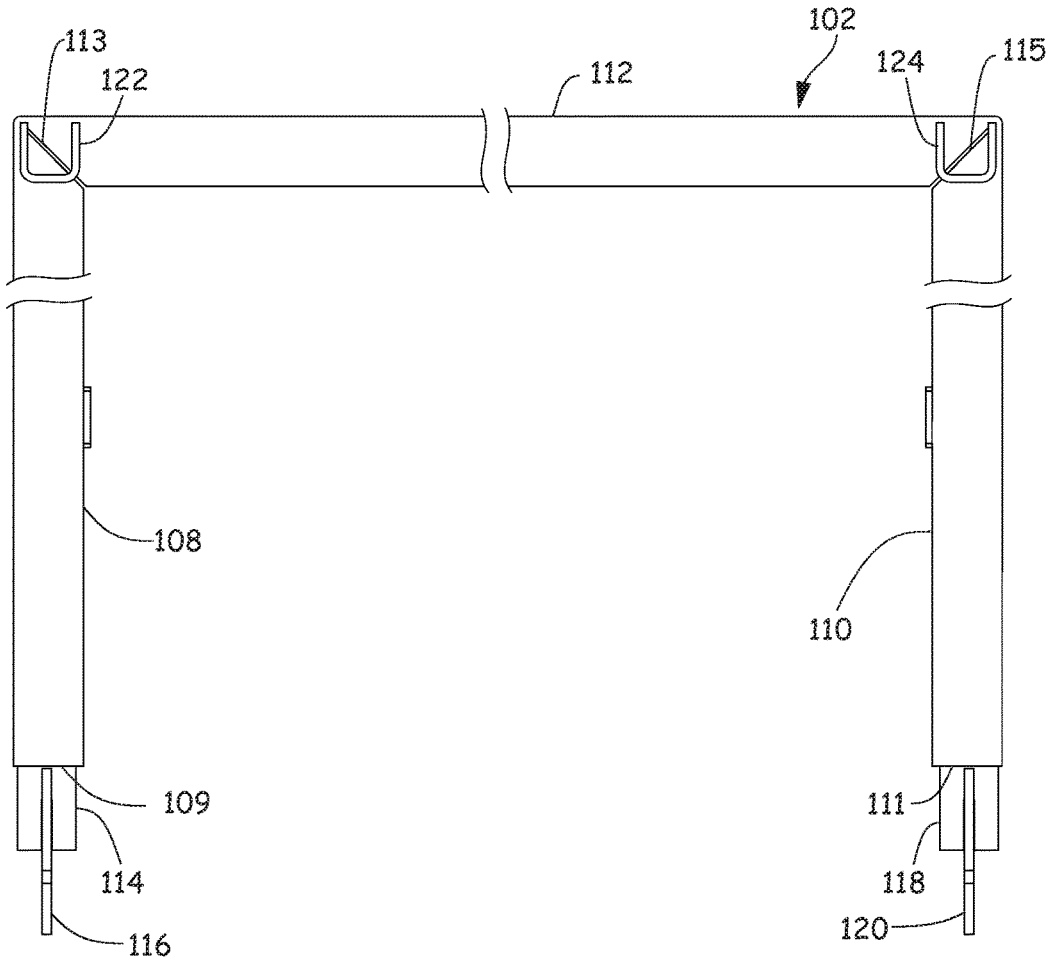
FIG. 10 is a bottom view of FIG. 8.

FIG. 8 is a front view, FIG. 9 is a left side view and FIG. 10 is a bottom view of portions of upper frame 102 of inline display focal or highlighter 100. Upper frame 102 includes a plurality of members that are, for example, tubular members, including a left member 108 having a fixed end 109 and a free end 113, a right member 110 having a fixed end 111 and a free end 115 and a cross member 112. Cross member 112 connects free end 113 of left member 108 to free end 115 of right member 110. Fixed end 109 of left member 108 is coupled to a bracket tube 114, which is coupled to a bracket 116. Fixed end 111 of right member 110 is coupled to a bracket tube 118, which is coupled to a bracket 120. Brackets 118 and 120 mount upper frame 102 to gondola section 201*b* of gondola display unit 200 using uprights 208*b* and 208*c*. As mentioned, upright 208*b* is shared with the adjacent gondola section 201*a* that is to the left of gondola section 201*b* and upright 208*c* is shared with the adjacent gondola section 201*c* that is to the right of gondola section 201*b*.

Upon right and left members 108 and 110 being mounted to uprights 208*b* and 208*c*, a portion of upper frame 102 extends forward from base deck 204*b* and toe kick 206*b* (clearly illustrated in the FIG. 3 top view) located on the front of base deck 204*b*. In fact, a portion of upper frame 102 extends forward from each base deck 204*a*, 204*b* and 204*c* and each toe kick 206*a*, 206*b* and 206*c* of all of the plurality of gondola sections 201*a*, 201*b* and 201*c*. In particular, the lengths of right and left members 108 and 110 are greater than the depths of the combined base deck 204*b* and toe kick 206*b*. The portions of upper frame 102 that are located forward from base deck 204*b* and toe kick 206*b* include the entirety of cross member 112 and free ends 113 and 115 of left and right members 108 and 110, respectively.

Upper frame 102 further includes a pair of connectors 122 and 124 (FIGS. 5 and 7) that protrude or depend downwardly from left, right and cross members 108, 110 and 112. In particular, first connector 122 depends downwardly from the intersection of free end 113 of left member 108 and cross member 112 and right connector 124 depends downwardly from the intersection of free end 115 of right member 110 and cross member 112. Each of connectors 122 and 124 are U-shaped as illustrated in FIG. 10.

Outrigger 104 includes a pair of vertical members 126 and 128 that are, for example, tubular, including left vertical member 126 having a top end or first end 125 and a bottom end or second end 127 and right vertical member 128 having a top end or first end 129 and a bottom end or second end 130 (see FIG. 7). Top end 125 of left vertical member 126 engages with or mates with the entirety of first connector 122 so that top end 125 and left vertical member 126 receives first connector 122 and top end 125 abuts a bottom of the intersection of left member 108 and cross member 112. Top end 129 of right vertical member 128 engages with or mates with the entirety of second connector 124 so that top end 129 and right vertical member 128 receives second connector 124 and top end 129 abuts a bottom of the intersection of right member 110 and cross member 112.

In other words, outrigger 104 including vertical members 126 and 128 are positioned forward from base deck 204*b* and toe kick 206*b* and also forward from each base deck 204*a*, 204*b* and 204*c* and each toe kick 206*a*, 206*b* and 206*c* of all of the plurality of gondola sections 201*a*, 201*b* and 201*c*. Further, outrigger 104 includes vertical members 126 and 128 that depend downwardly from upper frame 102 to couple or engage bottom ends or second ends 127 and 130 with kick plate assembly 106.

Figure 11:
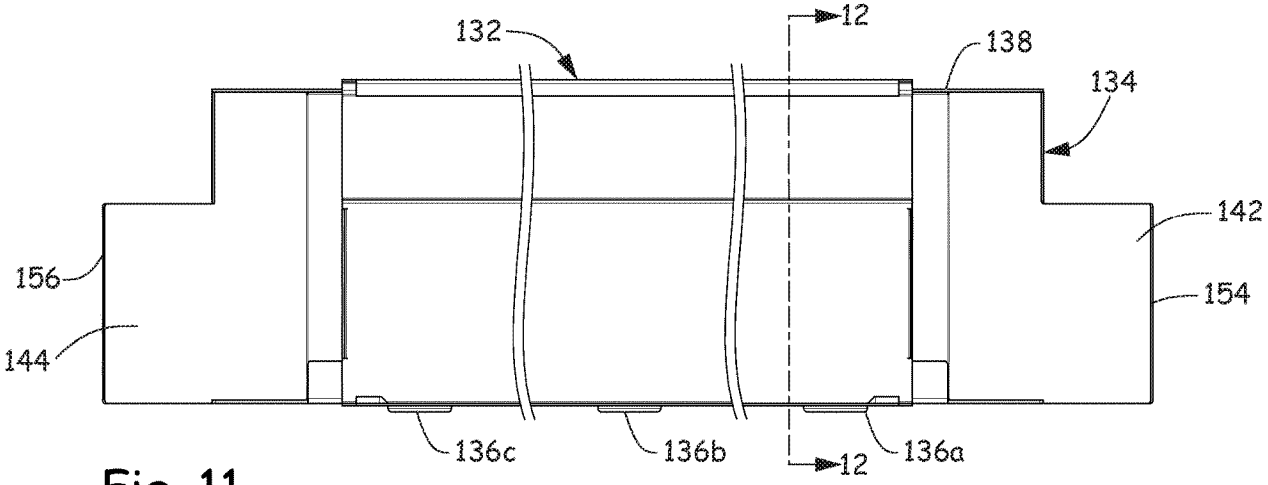
FIG. 11 is a back view of portions of the kick plate assembly of the inline display focal illustrated in FIG. 7.
Figure 12:
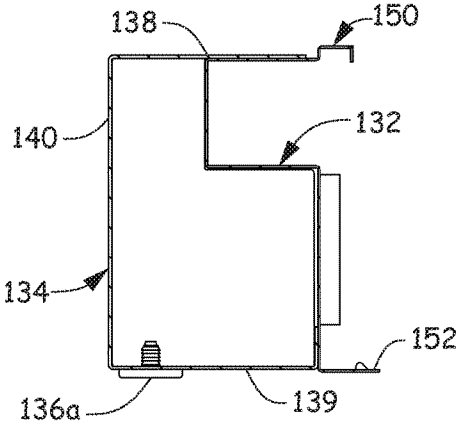
FIG. 12 is a section view taken through the section line in FIG. 11.
Figure 13:
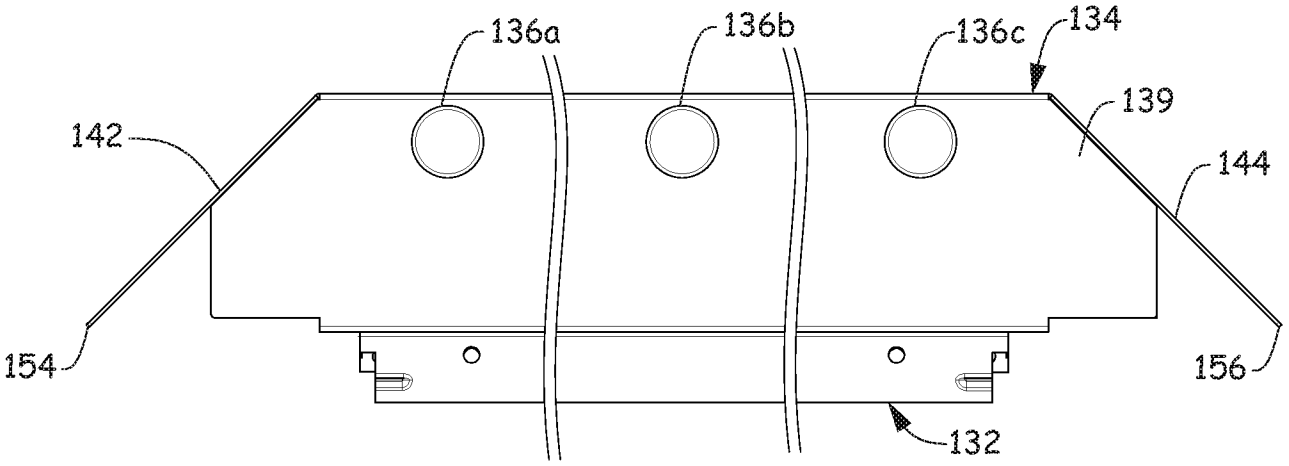
FIG. 13 is a bottom view of FIG. 11.

FIG. 11 is a back view, FIG. 12 is a section view taken through the section line in FIG. 11 and FIG. 13 is a bottom view of kick plate assembly 106 of inline display focal 102. Kick plate assembly 106 includes a bumpered kick plate 132, an extension kick plate 134 and a plurality of feet 136*a*, 136*b* and 136*c*. As illustrated in FIGS. 7, 11, 12 and 13, extension kick plate 134 includes a top 138, a bottom 139, a front 140 and a pair of angled sides 142 and 144. Top 138 includes a pair of apertures 146 and 148. First aperture 146 is located proximate to first angled or left angled side 142 and second aperture 148 is located proximate to second angled or right angled side 144. In one embodiment, apertures 146 and 148 receive second ends 127 and 130 of respective vertical members 126 and 128. Second ends 127 and 130 terminate and rest inside kick plate assembly 106. Bottom 139 supports the plurality of feet 136*a*, 136*b* and 136*c*.

In one embodiment, bumpered kick plate 132 is made of a single sheet of material, such as metal, and provides the inner skin of kick plate assembly 106, and extension kick plate 134 is also made of a single sheet of material, such as metal, and provides the outer skin of kick plate assembly 106. Bumpered kick plate 132 and extension kick plate 134 are coupled together so that bumpered kick plate 132 is configured to attach kick plate assembly 106 and therefore extension kick plate 134 to a front of toe kick 206*b* of gondola section 201*b* of gondola display unit 200. In particular, bumpered kick plate 132 plate includes a bent top end 150 that attaches to the front of toe kick 206*b*. While top 138, front 140 and bottom 139 of extension kick plate 134 surround most of bumpered kick plate 132, extension kick plate 134 does not cover bent top end 150 or bottom end 152.

Left angled side 142 of extension kick plate 134 includes an outer edge 154 and right angled side 144 of extension kick plate 134 includes an outer edge 156. Outer edge 154 of left angled side 142 is located adjacent to a front of toe kick 206*a* of gondola section 201*a* that is to a left of gondola section 201*b*, where gondola section 201*b* is the gondola section that is to be highlighted. Outer edge 156 of right angled side 144 is located adjacent to a front of toe kick 206*c* of gondola section 201*c* that is to a right of gondola section 201*b*, where gondola section 201*b* is the gondola section that is to be highlighted. The abutment of outer edges 154 and 156 with toe kicks 206*a* and 206*b*, respectively, is possible with cut outs located in top portions of outer edges 154 and 156.

Feet 136*a*, 136*b* and 136*c* are mounted through bottom 139 of extension kick plate 134. Feet 136*a*, 136*b* and 136*c* help support inline gondola focal or highlighter 100.

By providing inline gondola focal or highlighter 100, a method of drawing customer attention to merchandise located on one or a plurality of gondola sections 201*a*, 201*b* and 201*c* in a retail store is achieved. This is done by cantilevering upper frame 102 from the pair of uprights 208*b* and 208*c* of gondola section 201*b*. Upper frame 102 extends forward from base deck 204*b* of gondola section 201*b*, but also from base decks 204*a* and 204*c* of adjacent gondola sections. Outrigger 104 having two vertical members 126 and 128 that depend downwardly from upper frame 102 is positioned to be located forward from base deck 204*b* of gondola section 201*b*, but also from base decks 204*a* and 204*c* of adjacent gondola sections. Kick plate assembly 106 is attached to a front of toe kick 206*b* so that kick plate assembly 106 is located forward of base deck 204*b*, but also located forward from base decks 204*a* and 204*c* of adjacent gondola sections. Kick plate assembly 106 also attaches to vertical members 126 and 128 of outrigger 104. In addition, attaching at least one shelf 202 to the pair of uprights 208*b* and 208*c* draws customer attention to merchandise on shelf 202 by upper frame 102, vertical members 126 and 128 of outrigger 104 and kick plate assembly 106 circumscribing shelf 202.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display fixture comprising:

a gondola display unit including a plurality of adjacent gondola sections, each gondola section having:

a base deck configured to rest upon a floor, a back wall supported by a pair of uprights and a toe kick located on a front of the base deck; and an inline display focal coupled to the gondola display unit to highlight a first gondola section from the plurality of adjacent gondola sections; the inline display focal including an upper frame, an outrigger and a kick plate assembly, wherein a portion of the upper frame extends forwardly relative to the base decks and the toe kicks of the gondola sections, the outrigger is positioned forward of a corresponding base deck of the first gondola section and a corresponding toe kick of the first gondola section and includes at least two vertical members that depend downwardly from the upper frame to couple to the kick plate assembly that is attached to a front of the corresponding toe kick of the first gondola section; wherein the kick plate assembly substantially covers the entire corresponding toe kick of the first gondola section; wherein the base deck of the first gondola section and the toe kick of the first gondola section have a first width;

wherein the kick plate assembly has a second width that is greater than the first width, wherein the kick plate assembly comprises a left side and a right side; wherein the left side is fitted against a front of a respective toe kick of a second gondola section from said plurality of gondola sections that is to a left of the first gondola section and the right side is fitted against a front of a respective toe kick of a third gondola section from said plurality of gondola sections that is to a right of the first gondola section.

2. The display fixture of claim 1, wherein the upper frame comprises a left member and a right member each secured to the pair of uprights of the first gondola section at fixed ends and extend forward from the base deck and the toe kick of the first gondola section to free ends.

3. The display fixture of claim 2, wherein the upper frame further comprises a cross member that connects the free end of the left member to the free end of the right member.

4. The display fixture of claim 2, wherein the upper frame further comprises a first connector and a second connector each depending downwardly from the free end of the left member and the free end of the right member of the upper frame and configured to receive first ends of the vertical members of the outrigger.

5. The display fixture of claim 4, wherein second ends of the vertical members of the outrigger engage with the kick plate assembly.

6. The display fixture of claim 1, wherein the kick plate assembly comprises a bumpered kick plate and an extension kick plate, wherein the extension kick plate comprises an outer skin and the bumpered kick plate comprises an inner skin that is coupled to the extension kick plate and mounted to the front of the toe kick of the first gondola section.

7. The display fixture of claim 6, wherein the extension kick plate comprises a left angled side having a free edge and a right angled side having a free edge, the free edge of the left angled side is fitted against the front of the respective toe kick of the second gondola section and the free edge of the right angled side is fitted against the front of the respective toe kick of the third gondola section.

8. The display fixture of claim 1, further comprising at least one shelf attached to the uprights of the first gondola section.

9. The display fixture of claim 1, wherein the kick plate assembly comprises a bumpered kick plate and an extension kick plate, wherein the extension kick plate comprises an outer skin and the bumpered kick plate comprises an inner skin that is coupled to the extension kick plate and mounted to the front of the toe kick of the first gondola section.

10. The display fixture of claim 9, wherein the extension kick plate comprises the angled left side having a free edge and the angled right side having a free edge, the free edge of the angled left side is fitted against the front of the respective toe kick of the second gondola section and the free edge of the angled right side is located adjacent to a front of the toe kick of the third gondola section.

11. A display fixture comprising:

a gondola display unit including a plurality of adjacent gondola sections, each gondola section having:

a base deck configured to rest upon a floor, a back wall supported by a pair of uprights and a toe kick located on a front of the base deck; and a highlighter coupled to the gondola display unit to highlight a first gondola section from the plurality of adjacent gondola sections; the highlighter includes an upper frame, an outrigger and a kick plate assembly, wherein the upper frame is coupled to the uprights of the first gondola section and extends forwardly relative to the base decks and the toe kicks of the plurality of gondola sections, the outrigger is positioned forward of the base decks and the toe kicks of the plurality of gondola sections and includes at least two vertical members that depend downwardly from the upper frame to couple to the kick plate assembly that is attached to a front of the toe kick of the first gondola section, wherein the kick plate assembly substantially covers the entire corresponding toe kick of the first gondola section; wherein the base deck of the first gondola section and the toe kick of the first gondola section have a first width;

wherein the kick plate assembly has a second width that is greater than the first width, wherein the kick plate assembly comprises an angled left side and an angled right side; wherein the angled left side is configured to be fitted against a front of a respective toe kick of a second gondola section from said plurality of gondola sections that is to a left of the first gondola section and the angled right side is configured to be fitted against a front of a respective toe kick of a third gondola section from said plurality of gondola sections that is to a right of the first gondola section.

12. The display fixture of claim 11, wherein the upper frame comprises a left member and a right member each secured to the pair of uprights of the first gondola section at fixed ends and extend forward from the base deck and the toe kick of the first gondola section to free ends.

13. The display fixture of claim 12, wherein the upper frame further comprises a cross member that connects the free end of the left member to the free end of the right member.

14. The display fixture of claim 12, wherein the upper frame further comprises a first connector and a second connector respectively depending downwardly from the free end of the left member and the free end of the right member of the upper frame and configured to receive first ends of the respective vertical members of the outrigger.

15. The display fixture of claim 14, wherein second ends of the vertical members of the outrigger engage with the kick plate assembly.

16. The display fixture of claim 11, further comprising at least one shelf attached to the uprights of the one of the first gondola section.

17. A display fixture comprising:

a gondola display unit including a plurality of gondola sections;

each gondola section comprises:

a base deck configured to rest upon a floor, a back wall extending upwardly from the base deck, a pair of uprights and a toe kick located on a front of the base deck;

an upper frame cantilevered from a pair of corresponding uprights of a first gondola section from said plurality of gondola sections that is located adjacent to a second gondola section from said plurality of adjacent gondola sections and a third gondola section from said plurality of gondola sections;

the upper frame extending forwardly relative to the base decks and toe kicks of the plurality of gondola sections;

an outrigger including two vertical members that depend downwardly from the upper frame, wherein the vertical members are located forward of the base decks and the toe kicks of the plurality of gondola sections; and a kick plate assembly mounted to a corresponding toe kick of the first gondola section so that the kick plate assembly substantially covers the entire corresponding toe kick of the first gondola section and is located forward of the base decks and the toe kicks of the plurality of gondola sections and is also attached to the two vertical members of the outrigger;

wherein the kick plate assembly comprises an angled left side, an angled right side, and a top surface; wherein bottom ends of the vertical members are directly attached to the top surface of the kick plate assembly and spaced apart from an outer edge of the angled left side and an outer edge of the angled right side of the kick plate assembly.

18. The display fixture of claim 17, further comprising at least one shelf that is attached to the pair of uprights so that the upper frame, the two vertical members of the outrigger and the kick plate assembly circumscribe the shelf.

19. The display fixture of claim 17, wherein ends of the vertical members of the outrigger are inserted into apertures in a top of the kick plate assembly.

* * * * *